United States Patent [19]

Taoka

[11] Patent Number: 4,825,636

[45] Date of Patent: May 2, 1989

[54] BALLOONING CONTROL RINGS FOR SPINNING MACHINERY

[75] Inventor: Satoru Taoka, Itami, Japan

[73] Assignee: Kanai Juyo Kogyo Co., Ltd., Hyogo, Japan

[21] Appl. No.: 116,738

[22] Filed: Nov. 4, 1987

[30] Foreign Application Priority Data

Nov. 10, 1986 [JP] Japan ..... 61-172421[U]

[51] Int. Cl.[4] ..... D01H 13/12; D01H 7/62; D01H 13/04

[52] U.S. Cl. ..... 57/355; 57/120; 57/354; 57/357

[58] Field of Search ..... 57/119, 120, 354–357

[56] References Cited

U.S. PATENT DOCUMENTS 3,638,415 2/1972 Andrews ..... 57/355
4,397,143 8/1983 Klein ..... 57/355

*Primary Examiner*—John Petrakes
*Attorney, Agent, or Firm*—Wenderoth, Lind & Ponack

[57] ABSTRACT

A ballooning control ring for spinning machinery which has an annular body made of sintered material having a groove in which lubricating a lubricating wick is disposed, a cover body covering said groove and a handle fitting body. The lubricating wick in the groove is connected to an automatic oiling device provided below the handle fitting body. This ring prevents oil-soiling of the annular body and consequently prevents production of oil-stained yarn.

6 Claims, 2 Drawing Sheets

(A)

(B)

BALLOONING CONTROL RINGS FOR SPINNING MACHINERY

BACKGROUND OF THE INVENTION

1. Field of the Invention

This invention relates to an improvement in ballooning control rings to be used for ring spinning, ring twisting, etc.

2. Description of the Prior Art

As a conventional ballooning control ring to be used for ring spinning, ring twisting, etc., a device disclosed in published Japanese Utility Model Registration Application No. 61-11238, for example, is available. This device, as shown in FIG. 6, comprises an annular body 40 and a fitting member 41 which is fixed to the former by welding. The annular body 40 has at its upper part an oil storing groove 42, extending over almost the entire circumference of body 40, and which is covered with an annular cover 43. In this conventional ballooning control ring, however, oil in the oil storing groove easily leaks out, although the groove has a cover, due to vibration of the machine body during operation and due to other causes. Also, not only is the supplying of oil to the oil storing groove troublesome and time consuming but also "fly waste" easily contaminates oil which has spilled when the oil was supplied, resulting in the deterioration of yarn quality. Moreover, since the fitting member and the annular body which is made of sintered material are fixed together by welding, not only is the welding time consuming and costly but also the welded part breaks easily.

SUMMARY OF THE INVENTION

An object of the present invention is to eliminate the drawbacks of the conventional ballooning control ring, namely, to provide a ballooning control ring to be used for ring spinning, ring twisting, etc. which eliminates the problem of oil leakage from the annular body and of oil spilling during the supply thereof, thereby preventing the production of oil-stained yarn due to "fly waste" sticking thereto and improving the yarn quality and yarn strength.

Another object of the present invention is to allow the oil supplying operation to be performed easier and to simplify the assembling of the ballooning control ring.

The present invention is characterized in that an annular body part comprises an annular body made of sintered material which has an annular groove, in which lubricating yarn is disposed, extending over almost the entire circumference of the body, and a plate-like supporting body comprising a fitting part which is detachably fitted to the annular body and supports it and a fitting handle part. The annular groove in which the lubricating yarn is disposed is provided with a cover by which it is hermetically sealed and covered or the annular groove is covered by the plate-like supporting body. The lubricating yarn in the annular groove is connected to an automatic oiling device which is a collective oiling tank or a cartridge type oiling tank inserted in a cassette holder.

BRIEF DESCRIPTION OF THE DRAWINGS

The nature and advantages of the present invention will be understood more clearly from the following description made with reference to the accompanying drawings, in which:

FIGS. 1–3 show an embodiment of the present invention, of which FIG. 1 is a plan view, FIG. 2 shows a cross section of the invention, taken along the line A—A in FIG. 1 and FIG. 3 is a partial view of FIG. 2, on an enlarged scale;

FIGS. 4–5 show another embodiment of the present invention, of which FIG. 4 is a plan view of the main part, FIG. 5A shows a cross section of the invention, taken along the line B—B in FIG. 4 and FIG. 5B is a partial view of FIG. 5A, on an enlarged scale.

DETAILED DESCRIPTION OF THE PREFERRED EMBODIMENTS

The present invention is described below with reference to the accompanying drawings.

Embodiment 1

Figure 1:
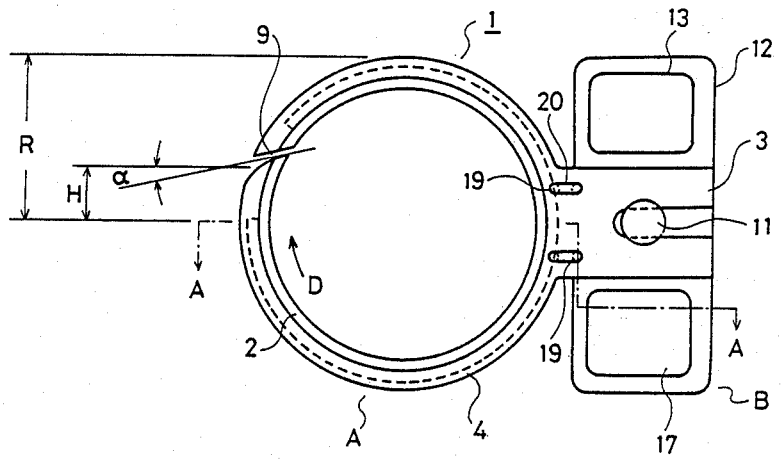
Figure 2:
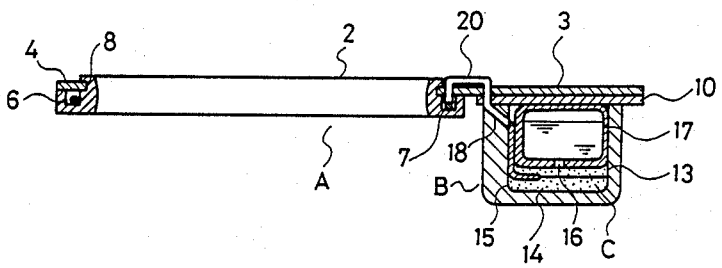

As shown in FIG. 1 and FIG. 2, a ballooning control ring 1 has an annular body part A comprising an annular body 2 formed from metal or a sintered body, such as sintered metal, and a cover body 4 having a handle part 3 and an automatic oiling device B which is integral with the handle part 3.

Figure 3:
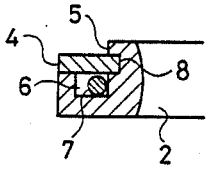
Figure 6:
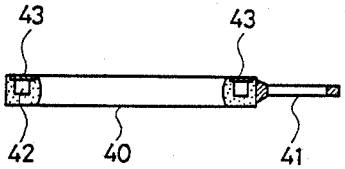
Fig 6 PRIOR ART
FIG. 6 shows a cross section of a conventional control ring.

As shown in FIG. 3, the annular body 2 has an L-shaped shoulder extending from a side wall 5 at about one-third of the width of the upper part of the annular body and an annular groove 6, in which lubricating yarn is disposed, extending therearound over almost the entire circumferential portion of body 2. A groove 8 extends in the side wall 5 and the cover body 4 which covers and hermetically seals the groove 6 extends therein to form a supporting body with handle fitting part 3,10 for securing annular body part A to a bracket (not shown). The cover body 4 is made by punching a metal plate, such as steel plate, aluminum plate or the like, or by the injection molding of thermoplastic or thermosetting synthetic resin.

As shown in FIG. 1, the annular body part A has a yarn leading-in slit 9 which is disposed a distance H to the right (in the case of S-twist) or to the left (in the case of Z-twist), as seen from the front, of an axial line passing through the center of the annular body 2 and approximately through the center of the fitting handle part 3. The distance H from the axial line is 0.35–0.45 of the radius R (half of the outside diameter of the annular body 2) and the leading-in slit is inclined in the yarn sliding direction (arrow D) at an angle $\alpha$ within the range of 10°–20° (in FIG. 1, the case of Z-twist is shown).

An automatic oiling device B is provided at the fitting handle part 3,10 of the annular body part A. This device B is fixed to the bracket (not shown in the drawings) by a threaded bolt 11, with handle part 10 and the handle part 3 superposed. The device B has a lubricating adjusting part C filled with oil-retaining substances 14, such as fibrous material, felt, sponge, etc., at the bottom of a groove 13 in which at least one cartridge type oiling tank is disposed. One end 15 of the lubricating yarn 7 is disposed in the oil retaining substance 14. A cartridge type oiling tank 17 is detachably mounted in the groove 13. The cartridge type oiling tank 17 is made of synthetic resin, light metal or the like and has an oil leading hole 16 1–5 mm in diameter at its bottom. This oil leading hole 16 contacts the upper surface of the oil retaining substance 14, and thus, lubricating oil in the tank 17 soaks into the oil retaining substance 14. A lubricating yarn pipe inserting part 18 is defined at a side wall (at the side of the annular body part A) of a holder 12 of the automatic oiling device B. A lubricating yarn pipe 20 extends from the lubricating yarn pipe inserting part 18 and through a hole 19 defined in the handle part 3 of the annular body. The lubricating yarn 7 in the groove 6 of the annular body part A thus extends through the pipe 20 and has one end disposed in the oil retaining substance 14.

In the above-described embodiment, the annular body 2 is made of sintered metal using pure iron powder but can be made of sintered metal using alloy powder, sintered metal using iron and alloy mixed powder or can comprise a resin sintered body made of resin powder and grains. In any case, it is required to prevent the leakage of oil by subjecting the outer circumferential surface and the under surface of the annular body to a pore-blocking up treatment, but the inner circumferential surface which requires a supply of oil is not subjected to such treatment. Case-hardened steel, carbon steel, etc. can also be used, but in this case a plurality of holes which extend from the groove 6 to the inner circumferential surface of the annular body are made for allowing oil to ooze therethrough.

The reason why the yarn leading-in slit 9 is positioned 0.35 R–0.45 R from the center line is that such a position affords the best yarn-tieing operation. The reason why the angle 2 at which the yarn leading-in slit 9 is inclined is 10°–20° the angle 2 is less than 10°, end portions at the cut part of the annular body A are staggered and such staggering can cause yarn breakage, and if the angle 2 is more than 20°, end portions at the cut part are too angular and this can cause yarn breakage, difficulty in the leading in of yarn and the lowering of the yarn-tieing operation efficiency.

Embodiment 2

Figure 4:
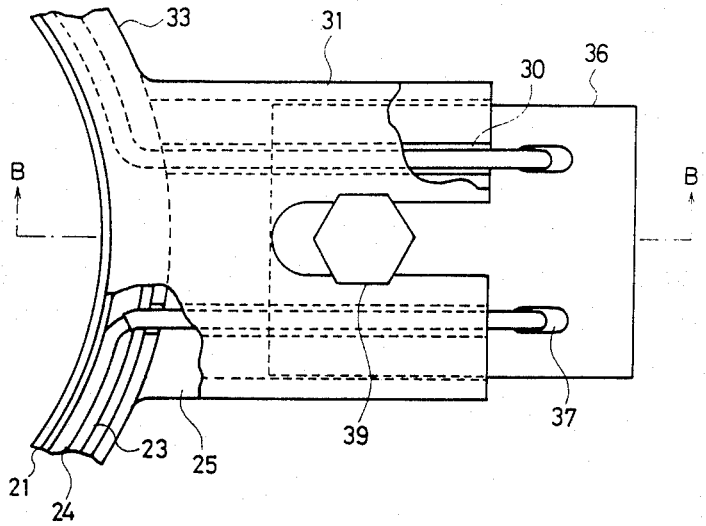
Figure 5:
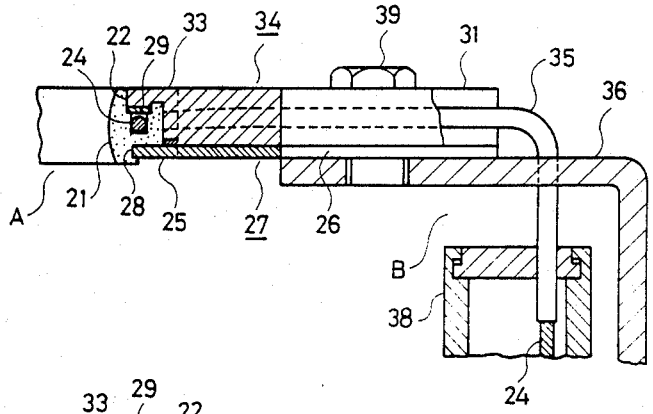
Figure 5:
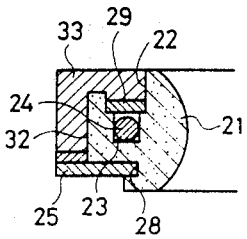

As shown in FIG. 4 and FIG. 5, an annular body 21 made of sintered metal has an L-shaped shoulder extending from a side wall 22 over almost the entire circumference of the body, and a groove 23 in which lubricating yarn 24 is disposed. The open part of the groove 23 defines a shoulder on which a packing 29 for preventing oil leakage is placed. A groove 28 extends in the lower part of the annular body 21. Detachably fitted in this groove 28 is a plate-like supporting body 27 comprising a ring-like fitting part 25 integral with a handle part 26 fitted to a bracket 36 along with handle part 31 to which the annular body 21 is secured. Fitted to the upper part of the packing 29 for preventing oil leakage is a cover body 34 comprising the handle part (covering part) 31 defining a groove 30 for receiving a lubricating yarn pipe 35 and an integral cover portion 33 for covering the groove 23 and the outer circumferential surface 32 of the annular body 21. The handle part 31 and 26 comprising the fitting handle part of the annular body part A are superposed on bracket 36 by a threaded bolt 39. The automatic oiling device B is provided below the bracket 36. The lubricating yarn pipe 35 is disposed in groove 30 at the handle part (covering part) 31, extends through a hole 37 defined in the bracket 36 and is connected to a collective oiling tank 38 comprising the automatic oiling device B. The lubricating yarn 24 extends in the collective oiling tank 38, whereby lubricating oil fed by the lubricating yarn 24 oozes from the inner circumferential surface of the annular body 21.

Similarly to Embodiment 1, a yarn leading-in slit (not shown) is defined in the annular body 21 and the plate-like supporting body 27 is formed by punching a metallic plate, such as a steel plate. However, other types of metallic plates or a synthetic resin plate can be used. The entire cover body 34 which hermetically seals the groove 23 for receiving lubricating yarn is made of synthetic resin, for example, nylon, polypropylene, tetrafluoroethylene, vinyl chloride, ABS resin, or resin which can be ejection-molded, or the fitting handle part (covering part) 31 can be made of a metal such as aluminum.

Lubricating oil in the above Embodiments 1 and 2 should preferably be lubricating oil generally used for spinning which prevents problems caused by frictional contact between yarn and the ballooning control ring and which also totally inhibits the generation of static electricity.

With respect to the automatic oiling device B, it is possible to replace the cartridge type oiling tanks in Embodiment 1 with a collective oiling tank or the collective oiling tank in Embodiment 2 with cartridge type oiling To compare the automatic oiling type ballooning control ring according to the present invention with the conventional non-lubricating type ballooning control ring, a spinning test was carried out under the following conditions.

| | |
|---|---|
| Yarn: | Polyester 30's (1.5 d × 38 mm cut) |
| Twist: | 18T/inch |
| Spindle revolution: | 16,000–17,000 r.p.m. |
| Ring: | 3.2 mm × 410 mm |
| Traveller: | Horizontal type traveller (MS/hf type) |

The results of the comparative test are shown in the following table.

| Ring | Traveller | Ballooning control | | Spindle revolution 16,000 r.p.m. (Traveller speed: 34 m/s) 20% Bobbin | 50% Bobbin |
|---|---|---|---|---|---|
| 3.2 mm × 410 mm | Horizontal type traveler (MS/hf No. 2) | Non-ballooning control | Yarn strength (g) | 527 | 553 |
| | | | Yarn elongation (%) | 18.7 | 19.8 |
| | | Wave type ballooning control | Yarn strength (g) | 425 | 498 |
| | | | Yarn elongation (%) | 15.7 | 18.0 |
| | | Ballooning control according to the invention | Yarn strength (g) | 533 | 551 |
| | | | Yarn elongation (%) | 18.7 | 19.2 |

As is obvious from the table above, as compared with the conventional wave type ballooning control ring (non-lubricating), the ballooning control ring according to the present invention does not cause the yarn strength to be extremely lowered and, in fact, the yarn strength and yarn elongation are maintained at approximately the same level as in a non-ballooning control ring. Moreover, with respect to yarn fluff, the ballooning control ring according to the present invention allows less fluffing than does the non-ballooning control ring and the same level of fluffing as in the wave type ballooning control ring. Furthermore, the ballooning control ring according to the present invention can prevent oil-stains and the generation of fused yarn and can produce yarn of good quality.

The ballooning control ring according to the present invention is free from oil oozing out through small openings of a cover, does not require a direct supply of oil to the groove made in the annular body, does not cause the annular body part to be soiled by oil spilling during oiling, eliminates oil-stained yarn caused by sticking of "fly waste", obviates the trouble of oiling, does not involve welding and improves productivity. Moreover, when the annular body is worn out, it can be exchanged easily by taking off the plate-like supporting body or the cover body.

As compared with the conventional non-lubricating system, under high speed operating conditions, the ballooning control ring according to the present invention does not result in a lowering of yarn strength and therefore improves yarn quality. Moreover, the present invention makes it possible to increase the spinning speed for spinning synthetic fiber. For example, when spinning polyester yarn, the spindle revolution can be increased from 11,000 r.p.m. to 14,000 r.p.m., i.e. about a 30% increase, thereby facilitating an improvement in production efficiency.

What is claimed is:

1. A ballooning control ring for controlling the ballooning of yarn being spun in spinning machinery, said control ring comprising:

a sintered annular body having an inner peripheral portion, an upper portion, a lubricating wick-receiving groove extending substantially therearound and open to said upper portion, and a cover body-receiving groove extending in said upper portion adjacent said lubricating wick-receiving grove, said inner peripheral portion being permeable to a lubricating oil;

a supporting body detachably mounted to said annular body for securing said annular body to a bracket, said supporting body comprising a cover portion detachably mounted to said annular body in said cover-body receiving groove and covering said lubricating wick-receiving groove, and a fitting handle part fixable to a bracket and extending from said cover portion;

an automatic oiling device for containing a supply of lubricating oil;

an oil pipe extending in said fitting handle part; and a lubricating wick extending from said automatic oiling device through said oil pipe and into said lubricating wick-receiving groove for conducting oil from said automatic oiling device into said lubricating wick-receiving groove.

2. A ballooning control ring for controlling the ballooning of yarn being spun in spinning machinery as claimed in claim 1, wherein said automatic oiling device comprises a holder, at least one recess extending in said holder, a cartridge containing oil disposed in each said at least one recess, an oil adjusting part disposed in the bottom of each said at least one recess and communicating with the cartridge disposed therein for regulating the flow of oil contained in the cartridge, and wherein said lubricating wick extends into the bottom of each said at least one recess so as to be in communication with the oil adjusting part therein.

3. a ballooning control ring for controlling the ballooning of yarn being spun in spinning machinery as claimed in claim 1, wherein said automatic oiling device comprises a collective oiling type oil storing tank for containing a supply of lubricating oil, and said oil pipe is open to said lubricating wick-receiving groove and extends into said oiling type oil storing tank,

4. A ballooning control ring for controlling the ballooning of yarn being spun in spinning machinery, said control ring comprising:

a sintered annular body having an inner peripheral portion, an upper portion, a lower portion, a lubricating wick-receiving groove extending substantially therearound and open to said upper portion, and a handle fitting part-receiving groove extending in said lower portion, said inner peripheral portion being permeable to a lubricating oil;

a supporting body detachably mounted to said annular body for securing said annular body to a bracket, said supporting body comprising a cover portion covering said lubricating wick-receiving groove, and a fitting handle part extending from said cover portion, said fitting handle part detachably mounted to said annular body in said fitting handle part-receiving groove and fixable to a bracket;

an automatic oiling device for containing a supply of lubricating oil;

an oil pipe extending in said fitting handle part and communicating with said automatic oiling device; and a lubricating wick extending from said automatic oiling device, through said oil pipe and into said lubricating wick-receiving groove for conducting oil from said automatic oiling device into said lubricating wick-receiving groove.

5. A ballooning control ring for controlling the ballooning of yarn being spun in spinning machinery as claimed in claim 4, wherein said automatic oiling device comprises a holder, at least one recess extending in said holder, a cartridge containing oil disposed in each said at least one recess, an oil adjusting part disposed in the bottom of each said at least one recess and communicating with the cartridge disposed therein for regulating the flow of oil contained in the cartridge, and wherein said lubricating wick extends into the bottom of each said at least one recess so as to be in communication with the oil adjusting part therein.

6. A ballooning control ring for controlling the ballooning of yarn being spun in spinning machinery as claimed in claim 4, wherein said automatic oiling device comprises a collective oiling type oil storing tank for containing a supply of lubricating oil, and said oil pipe is open to said lubricating wick-receiving groove and extends into said oiling type oil storing tank.

* * * * *